US009273660B2

(12) United States Patent
Koudu et al.

(10) Patent No.: US 9,273,660 B2
(45) Date of Patent: Mar. 1, 2016

(54) STARTER

(71) Applicant: DENSO CORPORATION, Kariya, Aichi-pref. (JP)

(72) Inventors: Takuma Koudu, Kariya (JP); Akina Kuwada, Kariya (JP)

(73) Assignee: DENSO CORPORATION, Kariya (JP)

( * ) Notice: Subject to any disclaimer, the term of this patent is extended or adjusted under 35 U.S.C. 154(b) by 524 days.

(21) Appl. No.: 13/644,435

(22) Filed: Oct. 4, 2012

(65) Prior Publication Data

US 2013/0087016 A1 Apr. 11, 2013

(30) Foreign Application Priority Data

Oct. 7, 2011 (JP) ..... 2011-222412

(51) Int. Cl.
*F02N 15/06* (2006.01)
*F02N 11/08* (2006.01)
*F02N 15/02* (2006.01)

(52) U.S. Cl.
CPC ..... *F02N 15/067* (2013.01); *F02N 11/0851* (2013.01); *F02N 15/022* (2013.01); *F02N 2015/061* (2013.01); *Y10T 74/132* (2015.01)

(58) Field of Classification Search
CPC ... F02N 15/023; F02N 15/022; F02N 15/067; F02N 11/00; F02N 15/06; Y10T 74/132; Y10T 74/134; Y10T 74/137
USPC ..... 74/6, 7 A, 7 C
See application file for complete search history.

(56) References Cited

U.S. PATENT DOCUMENTS

| | | | | |
|---|---|---|---|---|
| 4,818,889 | A * | 4/1989 | Kinoshita | 290/48 |
| 4,916,958 | A | 4/1990 | Okamoto et al. | |
| 5,432,384 | A * | 7/1995 | Isozumi et al. | 290/48 |
| 5,520,273 | A | 5/1996 | Moribayashi | |
| 5,697,527 | A | 12/1997 | Altieri, Jr. et al. | |
| 5,819,583 | A * | 10/1998 | Matsushima et al. | 74/7 E |
| 7,018,314 | B2 * | 3/2006 | Hasegawa et al. | 475/5 |
| 7,305,899 | B2 * | 12/2007 | Kajino et al. | 74/7 C |

(Continued)

FOREIGN PATENT DOCUMENTS

| | | |
|---|---|---|
| JP | S63-45433 A | 2/1988 |
| JP | H09-250432 A | 9/1997 |

(Continued)

OTHER PUBLICATIONS

U.S. Appl. No. 13/644,406, filed Oct. 4, 2012.

(Continued)

*Primary Examiner* — Terence Boes
(74) *Attorney, Agent, or Firm* — Oliff PLC

(57) ABSTRACT

In a starter, an output shaft is coaxially disposed with a rotating shaft of a motor. A pinion tube is helical-spline-fitted on the output shaft and has a pinion mounted on a non-motor-side end portion thereof. A shift lever is driven by an electromagnetic solenoid to shift both the pinion tube and the pinion relative to the output shaft in a direction away from the motor and thereby bring the pinion into mesh with a ring gear of an engine. A one-way clutch includes an outer arranged so as to be rotated by torque generated by the motor, an inner integrally formed with a motor-side end portion of the output shaft, and a plurality of intermediate members that are arranged between the outer and the inner so as to allow torque transmission from the outer to the inner and inhibit torque transmission from the inner to the outer.

9 Claims, 6 Drawing Sheets

(56) References Cited

U.S. PATENT DOCUMENTS

| | | | | |
|---|---|---|---|---|
| 2006/0144177 | A1 | 7/2006 | Andoh | |
| 2008/0314195 | A1* | 12/2008 | Andoh et al. | 74/7 |
| 2009/0205464 | A1* | 8/2009 | Takeuchi et al. | 74/7 |
| 2013/0087017 | A1* | 4/2013 | Kuwada et al. | 74/7 |

FOREIGN PATENT DOCUMENTS

| | | | |
|---|---|---|---|
| JP | H10-510234 | A | 10/1998 |
| JP | 2005-023907 | A | 1/2005 |
| JP | A-2006-177168 | | 7/2006 |
| JP | A-2007-146759 | | 6/2007 |
| JP | 2010-255706 | A | 11/2010 |

OTHER PUBLICATIONS

Sep. 18, 2014 Office Action issued in Chinese Patent Application No. 201210376361.7 (with translation).

Apr. 14, 2015 Office Action issued in Japanese Patent Application No. 2011-222412.

* cited by examiner (STOPPED STATE)

(DRIVING STATE)

STARTER

CROSS-REFERENCE TO RELATED APPLICATION

This application is based on and claims priority from Japanese Patent Application No. 2011-222412, filed on Oct. 7, 2011, the content of which is hereby incorporated by reference in its entirety into this application.

BACKGROUND

1. Technical Field

The present invention relates to starters which have a pinion tube spline-fitted on an output shaft and are configured to shift the pinion tube relative to the output shaft in a direction away from a motor and thereby bring a pinion supported on a non-motor-side end portion of the pinion tube into mesh with a ring gear of an engine.

2. Description of Related Art

There is known, for example from Japanese Patent Application Publication No. 2006-177168 (to be simply referred to as Patent Document 1 hereinafter), a starter that has a cantilever structure.

Specifically, as shown in FIG. 5, the starter includes: an output shaft 100 configured to be driven by a motor (not shown); a pinion tube 120 fitted on the output shaft 100 via a pair of bearings 110; a one-way roller clutch 130 configured to transmit rotation of the output shaft 100 to the pinion tube 120; a pinion 140 that is straight-spline-fitted on a non-motor-side end portion (i.e., a left end portion in FIG. 5) of the pinion tube 120; and a housing 160 that supports the pinion tube 120 via a bearing 150 axially positioned between the clutch 130 and the pinion 140. Further, the starter is configured so that with operation of an electromagnetic switch (not shown), the pinion tube 120 and the clutch 130 are together shifted relative to the output shaft 100 in the axial direction away from the motor (i.e., in the leftward direction in FIG. 5), thereby bringing the pinion 140 fitted on the pinion tube 120 into mesh with a ring gear (not shown) of an engine.

With the above configuration, however, the pinion tube 120, the clutch 130 and the pinion 140 together make up a moving body that is shifted by operation of the electromagnetic switch in the axial direction away from the motor for bringing the pinion 140 into mesh with the ring gear of the engine. Consequently, the mass of the moving body may be too large to minimize the size of the electromagnetic switch that is configured to create a magnetic attraction for shifting the moving body.

On the other hand, there is known, for example from Japanese Patent Application Publication No. 2007-146759 (to be simply referred to as Patent Document 2 hereinafter), another starter that also has a cantilever structure.

Specifically, as shown in FIG. 6, the starter includes a pinion shaft 170 that is helical-spline-fitted to the inner periphery of an inner 131 of the clutch 130 so as to be axially movable relative to the clutch 130. Further, on a non-motor-side end portion (i.e., a left end portion in FIG. 6) of the pinion shaft 170, there is mounted the pinion 140.

With the above configuration, only the pinion shaft 170 and the pinion 140 together make up a moving body that is shifted by operation of the electromagnetic switch in the axial direction away from the motor for bringing the pinion 140 into mesh with the ring gear of the engine. That is, the clutch 130 is kept axially unmoved and thus not included in the moving body. Consequently, the mass of the moving body can be reduced in comparison with that in the starter disclosed in Patent Document 1, thereby making it possible to minimize the size of the electromagnetic switch.

However, in the starter disclosed in Patent Document 2, the inner 131 of the clutch 130 has female helical splines formed on an inner periphery thereof, while the pinion shaft 170 has male helical splines formed on an outer periphery thereof for meshing with the female helical splines. Therefore, on the radially inside of the inner 131, there exists a radial clearance between the inner 131 and the pinion shaft 170 that are helical-spline-fitted to each other. On the other hand, on the radially outside of the inner 131, there exist both a radial clearance between the inner 131 and rollers 133 of the clutch 130 and a radial clearance between the rollers 133 and an outer 132 of the clutch 130. That is, the radial clearances exist on both the radially inside and outside of the inner 131. Consequently, the pinion shaft 170 may be considerably inclined due to the radial clearances, causing wear of other components including the bearing 150 for supporting the pinion shaft 170 and gears of a speed reducer (not shown) for reducing the rotational speed of the motor. As a result, it may be difficult to secure high durability (or a long service life) of the starter.

SUMMARY

According to an exemplary embodiment, there is provided a starter for starting an engine. The starter includes a motor, an output shaft, a clutch, a pinion tube, a pinion, a shift lever and an electromagnetic solenoid. The motor has a rotating shaft. The output shaft is coaxially disposed with the rotating shaft of the motor. The output shaft has male splines formed on an outer surface thereof. The clutch is configured to transmit torque generated by the motor to the output shaft. The pinion tube has a cylindrical bore formed therein. The pinion tube also has female splines formed on an inner surface of the cylindrical bore. The pinion tube is fitted on the output shaft with the female splines in mesh with the male splines of the output shaft. The pinion is provided on a non-motor-side end portion of the pinion tube so as to rotate with the pinion tube. The shift lever is configured to shift both the pinion tube and the pinion relative to the output shaft in a direction away from the motor and thereby bring the pinion into mesh with a ring gear of the engine. The electromagnetic solenoid is configured to drive the shift lever. Further, in the starter, the clutch is a one-way clutch which includes an outer, an inner and a plurality of intermediate members. The outer is arranged so as to be rotated by the torque generated by the motor. The inner is disposed radially inside of the outer so as to be rotatable relative to the outer. The inner is integrally formed with a motor-side end portion of the output shaft so as to rotate with the output shaft. The intermediate members are arranged between the outer and the inner so as to allow torque transmission from the outer to the inner and inhibit torque transmission from the inner to the outer.

With the above configuration, during the starting of the engine by the starter, the shift lever shifts both the pinion tube and the pinion relative to the output shaft in the direction away from the motor, thereby bringing the pinion into mesh with the ring gear of the engine. At the same time, both the output shaft and the clutch are kept unmoved in the direction away from the motor. That is, in the starter, only the pinion tube and the pinion together make up a moving body that is shifted by the shift lever in the direction away from the motor for bringing the pinion into mesh with the ring gear of the engine. Consequently, the mass of the moving body can be reduced in comparison with that in the starter disclosed in Patent Document 1.

Moreover, with the cylindrical bore formed in the pinion tube, it is possible to further reduce the mass of the pinion tube and thus the mass of the moving body that is comprised of the pinion tube and the pinion.

As a result, with the reduced mass of the moving body, it is possible to minimize the size of the electromagnetic solenoid, thereby minimizing the size of an electromagnetic switch which includes the electromagnetic solenoid.

Furthermore, in the starter, since the motor-side end portion of the output shaft is integrally formed with the inner of the clutch, the radial clearances existing in the clutch (i.e., the radial clearance between the outer and the intermediate members and the radial clearance between the inner and the intermediate members) are not at the same axial position as the radial clearance between the male splines of the output shaft and the female splines of the pinion tube. In other words, the radial clearances existing in the clutch are axially separated from the radial clearance between the male splines and the female splines. Consequently, it is possible to suppress inclination of the pinion tube relative to the output shaft due to all the radial clearances. As a result, it is possible to secure high durability (or a long service life) of the starter.

In further implementations, the electromagnetic solenoid may include an excitation coil that forms an electromagnet upon being supplied with electric power. The electromagnetic solenoid may drive the shift lever to shift both the pinion tube and the pinion in the direction away from the motor by means of attraction of the electromagnet.

The cylindrical bore of the pinion tube may have an open end on the motor side and a closed end on the non-motor side. The output shaft may be inserted in the cylindrical bore of the pinion tube with an internal space formed between a non-motor-side end of the output shaft and the closed end of the cylindrical bore. In the internal space, there may be preferably arranged a spring so as to urge the pinion tube relative to the output shaft in the direction away from the motor.

It is preferable that the starter further includes at least one washer interposed between a motor-side end of the spring and the non-motor-side end of the output shaft so as to be rotatable relative to the spring and the output shaft.

It is also preferable that the starter further includes at least one washer interposed between a non-motor-side end of the spring and the closed end of the cylindrical bore of the pinion tube so as to be rotatable relative to the spring and the pinion tube.

The pinion may be separately formed from the pinion tube and mounted on the pinion tube so as to be axially movable relative to the pinion tube. The pinion may be preferably urged in the direction away from the motor by a pinion spring that is arranged between the pinion and the pinion tube. The pinion may also be preferably restricted in movement in the direction away from the motor by a pinion stopper that is provided on the pinion tube so as to be positioned on the non-motor side of the pinion.

Furthermore, the pinion tube may be configured to have a main body and a pinion-sliding portion that is positioned on the non-motor side of the main body and has a smaller outer diameter than the main body; the main body has the cylindrical bore of the pinion tube formed therein, while the pinion-sliding portion has straight spline teeth formed on an outer surface thereof. The pinion may be configured to have a small-diameter bore that has straight spline grooves formed in an inner surface thereof and a large-diameter bore that is positioned on the motor side of the small-diameter bore and has a larger diameter than the small-diameter bore; the small-diameter and large-diameter bores respectively open at the non-motor-side and motor-side ends of the pinion and communicate with each other. The pinion-sliding portion of the pinion tube may be inserted in the small-diameter and large-diameter bores of the pinion with the straight spline teeth formed on the outer surface of the pinion-sliding portion of the pinion tube in mesh with the straight spline grooves formed in the inner surface of the small-diameter bore of the pinion. The pinion spring may be preferably axially interposed between a radially-extending outer shoulder that is formed between the outer surfaces of the main tube and pinion-sliding portion of the pinion tube and a radially-extending inner shoulder that is formed between the inner surfaces of the small-diameter and large-diameter bores of the pinion.

The cylindrical bore of the pinion tube may have an open end on the motor side and a closed end on the non-motor side. The cylindrical bore may also have a motor-side part and a non-motor-side part that has a smaller diameter than the motor-side part. The female splines of the pinion tube may be formed on the inner surface of the motor-side part of the cylindrical bore. A radial clearance between the inner surface of the non-motor-side part of the cylindrical bore and the outer surface of a non-motor-side part of the output shaft may be set so small that they make up sliding surfaces against each other. In the inner surface of the non-motor-side part of the cylindrical bore or in the outer surface of the non-motor-side part of the output shaft, there may be preferably formed grooves via which an internal space formed between a non-motor-side end of the output shaft and the closed end of the cylindrical bore communicates with the motor-side part of the cylindrical bore.

The starter may have such a cantilever structure that on the non-motor side of the pinion, there is provided no bearing for supporting the pinion tube.

BRIEF DESCRIPTION OF THE DRAWINGS

The present invention will be understood more fully from the detailed description given hereinafter and from the accompanying drawings of exemplary embodiments, which, however, should not be taken to limit the invention to the specific embodiments but are for the purpose of explanation and understanding only.

In the accompanying drawings.

DESCRIPTION OF EMBODIMENTS

Figure 1:
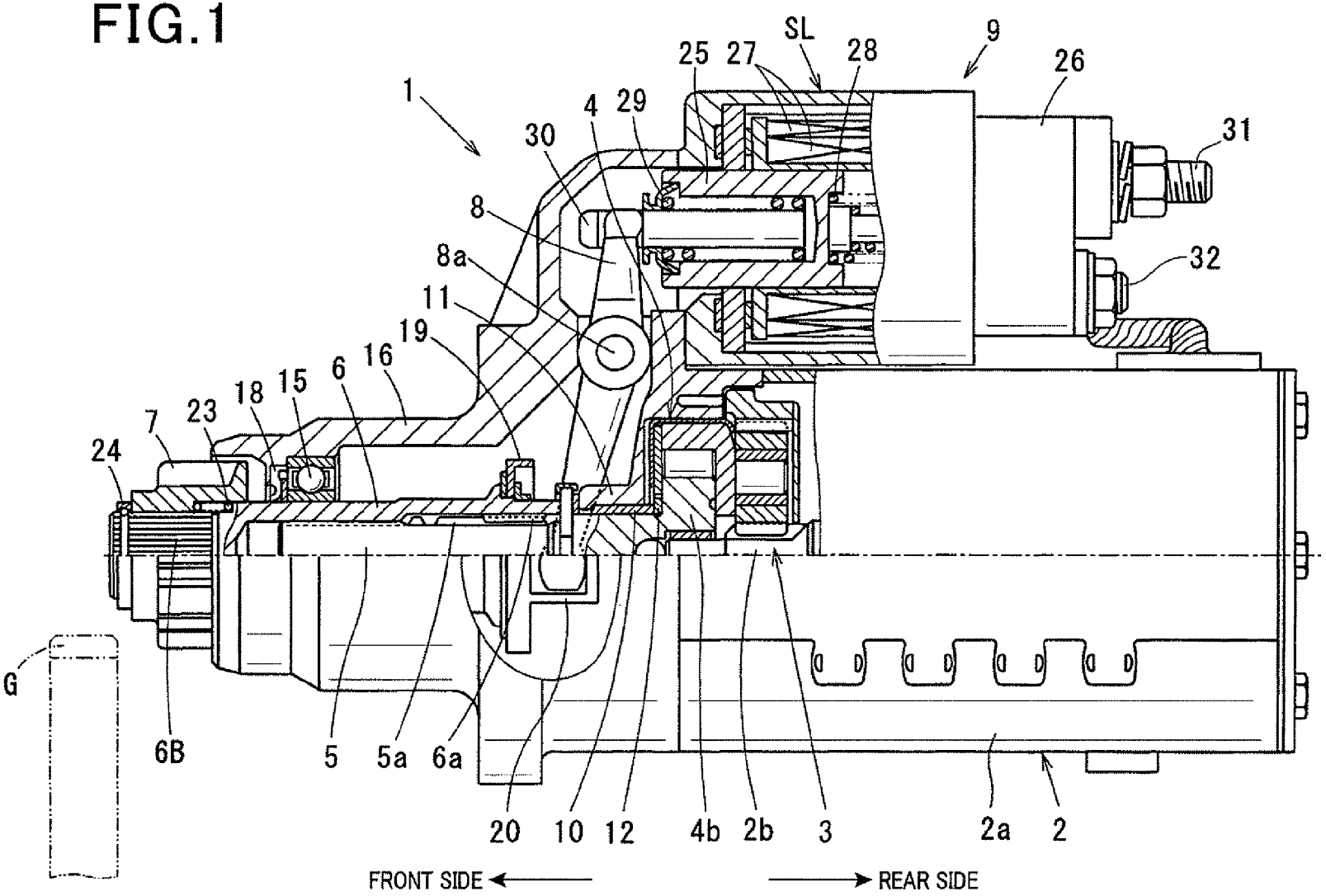
FIG. 1 is a partially cross-sectional view illustrating the overall structure of a starter according to a first embodiment.

Exemplary embodiments will be described hereinafter with reference to FIGS. 1-4. It should be noted that for the sake of clarity and understanding, identical components having identical functions in different embodiments have been marked, where possible, with the same reference numerals in each of the figures and that for the sake of avoiding redundancy, descriptions of the identical components will not be repeated.

First Embodiment

FIG. 1 shows the overall structure of a starter 1 according to a first embodiment. The starter 1 is designed to start an internal combustion engine (not shown) of a motor vehicle.

As shown in FIG. 1, the starter 1 includes: a motor 2 that generates torque; a speed reducer 3 that reduces the rotational speed of the motor 2; a clutch 4; an output shaft 5 that is mechanically connected to the output side of the speed reducer 3 via the clutch 4; a pinion tube 6 that is helical-spline-fitted to the outer periphery of the output shaft 5; a pinion 7 that is fitted on a non-motor-side end portion (i.e., a left end portion in FIG. 1) of the pinion tube 6 so as to rotate with the pinion tube 6; a shift lever 8 that is configured to shift both the pinion tube 6 and the pinion 7 relative to the output shaft 5 in the axial direction away from the motor 2 (i.e., in the leftward direction in FIG. 1) and thereby bring the pinion 7 into mesh with a ring gear G of the engine; and an electromagnetic switch 9 that is configured to operate supply of electric power to the motor 2 and drive the shift lever 8.

It should be noted that for the sake of convenience of explanation, the non-motor side in the axial direction of the output shaft 5 (or the axial direction of the starter 1) will be simply referred to as the front side and the motor side (i.e., the right side in FIG. 1) in the axial direction will be simply referred to as the rear side hereinafter.

The motor 2 is implemented by, for example, a DC commutator motor. Specifically, the motor 2 includes: a hollow cylindrical yoke 2*a* that also serves as a frame; a field (not shown) formed by arranging either a plurality of permanent magnets or a field winding on the radially inner periphery of the yoke 2*a*; an armature that has an armature shaft 2*b* rotatably disposed radially inside of the field and a commutator (not shown) provided on the outer periphery of the armature shaft 2*b*; and brushes (not shown) arranged to slide on the commutator during rotation of the armature shaft 2*b* so as to supply electric power to the armature.

In operation, when main contacts (not shown) of a motor circuit are closed by the electromagnetic switch 9, electric power is supplied from a battery (not shown) to the armature via the sliding contact between the brushes and the commutator. Consequently, torque is generated at the armature shaft 2*b* by interaction between the field and the energized armature.

Figure 2A:
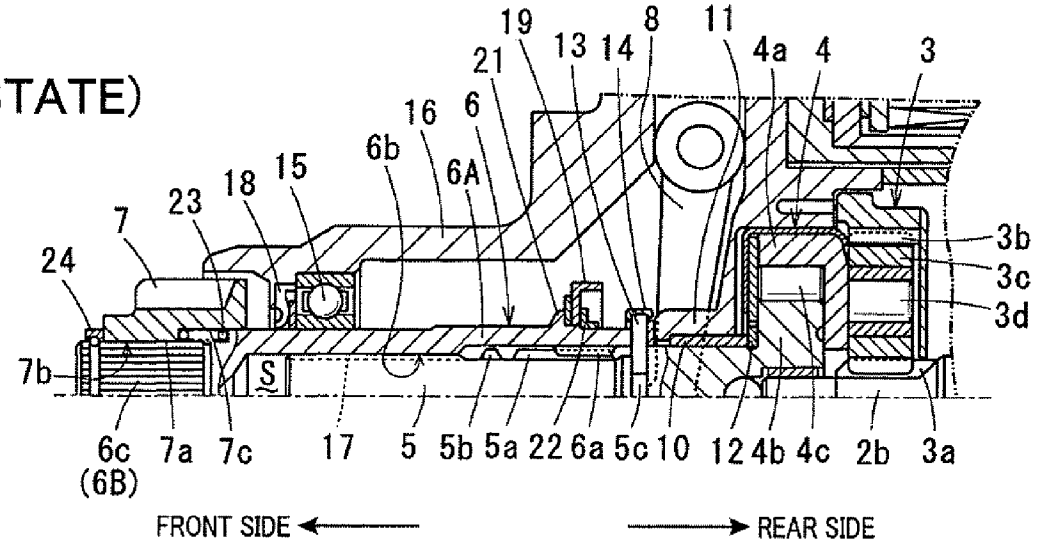
FIG. 2A is a partially cross-sectional view illustrating the positions of a pinion tube and a pinion of the starter when the starter is in a stopped state.

The speed reducer 3 is of, for example, a well-known epicyclic type (or planetary type). Specifically, as shown in FIG. 2A, the speed reducer 3 includes: a sun gear 3*a* provided on a front end portion (i.e., a left end portion in FIG. 2A) of the armature shaft 2*b* of the motor 2; an annular internal gear 3*b* concentrically arranged with the sun gear 3*a*; and a plurality (e.g., three) of planet gears 3*c* arranged so as to mesh with both the sun gear 3*a* and the internal gear 3*b*.

In operation, when the sun gear 3*a* rotates along with the armature shaft 2*b* of the motor 2, the planet gears 3*c* rotate about respective gear shafts 3*d* as well as orbit around the sun gear 3*a*, thereby reducing the rotational speed of the armature shaft 2*b* and the sun gear 3*a* to an orbital speed of the planet gears 3*c*.

Figure 2B:
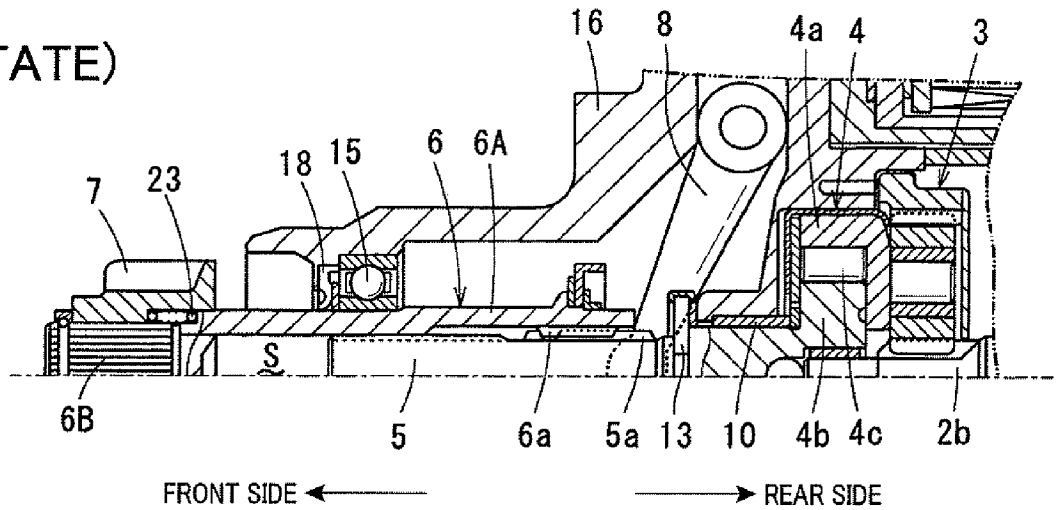
FIG. 2B is a partially cross-sectional view illustrating the positions of the pinion tube and the pinion when the starter is in a driving state.

The clutch 4 is implemented by a one-way roller clutch which is configured to allow torque transmission from the motor 2 to the engine and inhibit torque transmission from the engine to the motor 2. Specifically, as shown in FIGS. 2A-2B, the clutch 4 includes an outer 4*a*, an inner 4*b*, a plurality of rollers 4*c* and a plurality of springs (not shown). The outer 4*a* is integrally formed with the gear shafts 3*d* that respectively support the planet gears 3*c* of the speed reducer 3. The outer 4*a* also has a plurality of wedge-shaped cam chambers (not shown) formed in the inner periphery thereof. The inner 4*b* is disposed radially inside of the outer 4*a* so as to be rotatable relative to the outer 4*a*. Each of the rollers 4*c* is received in a corresponding one of the cam chambers of the outer 4*a* so as to be radially interposed between the outer 4*a* and the inner 4*b*. Each of the springs is arranged in a corresponding one of the cam chambers of the outer 4*a* so as to urge that one of the rollers 4*c* which is received in the corresponding cam chamber toward the narrower side of the corresponding cam chamber.

During the starting of the engine by the starter 1, the clutch 4 allows torque transmission from the outer 4*a* to the inner 4*b* by locking them together with the rollers 4*c*. On the other hand, when the engine has been completely started and thus the pinion 7 comes to be rotated by the engine, the clutch 4 enters an overrun state where it inhibits torque transmission from the inner 4*h* to the outer 4*a* with the rollers 4*c* freewheeling between the outer 4*a* and the inner 4*b*.

The output shaft 5 is coaxially disposed with the armature shaft 2*b* of the motor 2. The output shaft 5 has a rear end portion that is integrally formed with the inner 4*b* of the clutch 4 and rotatably supported by a center case 11 via a bearing 10. On the rear side of the bearing 10, there is disposed a washer 12 to suppress wear of the bearing 10 and the inner 4*h* of the clutch 4 due to relative rotation therebetween.

In addition, as shown in FIGS. 2A-2B, in the present embodiment, the bearing 10 is implemented by a sliding bearing (or plain bearing). However, it should be noted that the bearing 10 may also be implemented by other types of bearings, such as a ball bearing and a needle bearing.

Further, the output shaft 5 has male helical splines 5*a* that are formed on the outer surface of the output shaft 5 so as to be positioned forward from the rear end portion of the output shaft 5 which is supported by the bearing 10. The output shaft 5 also has a front stopper 5*b* that is formed on the outer surface of the output shaft 5 so as to be positioned forward from the male helical splines 5*a*. As will be described in detail later, the front stopper 5*b* is provided to stop the pinion tube 6 from being advanced further forward, thereby defining a maximum advanced position of the pinion tube 6.

Furthermore, the output shaft 5 also has an annular groove 5*c* that is formed in the outer surface of the output shaft 5 so as to extend over the entire circumference of the output shaft 5. The annular groove 5*c* is axially positioned between the male helical splines 5*a* and the rear end portion of the output shaft 5 which is supported by the bearing 10.

In the annular groove 5*c* of the output shaft 5, there is mounted a rear stopper (or stopping member) 13 to stop the pinion tube 6 from being retreated further backward, thereby defining a maximum retreated position of the pinion tube 6. In addition, the maximum retreated position also represents an initial rest position of the pinion tube 6.

More specifically, the rear stopper 13 is implemented by, for example, at least one E-clip that is fitted into the annular groove 5*c* of the output shaft 5. Further, a cover 14 is provided to cover the radially outer periphery of the E-clip, thereby preventing the E-clip from being radially moved out of the annular groove 5*c* by the centrifugal force during rotation of the output shaft 5.

The pinion tube 6 has, as shown in FIG. 2A, a main body 6A and a pinion-sliding portion 6B. The main body 6A has a cylindrical bore 6*b* formed therein. The cylindrical bore 6*b* extends in the axial direction of the pinion tube 6 and has an open end on the rear side and a closed end (or a bottom) on the front side. Further, on the inner surface of a rear part of the cylindrical bore 6*b*, there are formed female helical splines 6*a*. The pinion-sliding portion 6B is positioned on the front side of the main body 6A and has a smaller outer diameter than the main body 6A. Further, on the outer surface of the pinion-sliding portion 6B, there are formed straight spline teeth 6*e* that extend in the axial direction of the pinion tube 6.

The pinion tube 6 is rotatably and axially-slidably supported, at the outer surface of the main body 6A thereof, by a housing 16 via a bearing 15. Further, the pinion tube 6 has the output shaft 5 inserted in the cylindrical bore 6*b* of the main body 6A so that the pinion tube 6 is both rotatable and axially movable relative to the output shaft 5 via the meshing engagement between the male helical splines 5*a* of the output shaft 5 and the female helical splines 6*a* of the pinion tube 6. Furthermore, the pinion tube 6 assumes (or gets to) its maximum advanced position when the front ends of the female helical splines 6*a* are advanced to make contact with the read end of the front stopper 5*b* of the output shaft 5.

In addition, as shown in FIGS. 2A-2B, in the present embodiment, the bearing 15 is implemented by a ball bearing. However, it should be noted that the bearing 15 may also be implemented by other types of bearings, such as a needle bearing and a sliding bearing.

For the cylindrical bore 6*b* of the main body 6A of the pinion tube 6, the diameter of the rear part of the cylindrical bore 6*b* is set to be larger than that of a front part of the cylindrical bore 6*b*. As described previously, the female helical splines 6*a* are formed on the inner surface of the rear part of the cylindrical bore 6*b*. Further, the diameter of the rear part of the cylindrical bore 6*b* is substantially equal to the root diameter of the female helical splines 6*a*.

On the other hand, no splines are formed on the inner surface of the front part of the cylindrical bore 6*b*. Further, the radial clearance between the inner surface of the front part of the cylindrical bore 6*b* and the outer surface of a front part of the output shaft 5 is set to be smaller than the radial clearance between the male helical splines 5*a* of the output shaft 5 and the female helical splines 6*a* of the pinion tube 6. Consequently, the inner surface of the front part of the cylindrical bore 6*b* and the outer surface of the front part of the output shaft 5 make up sliding surfaces against each other. In addition, the front part of the output shaft 5 is positioned forward of the front stopper 5*b* so as to have the front stopper 5*b* axially interposed between the front part of the output shaft 5 and the male helical splines 5*a*.

Furthermore, in the outer surface of the front part of the output shaft 5, there are formed a plurality (e.g., two) of grooves 17 that extend in the axial direction of the output shaft 5. Via the grooves 17, an internal space S formed between the front end of the output shaft 5 and the closed end of the cylindrical bore 6*b* of the pinion tube 6 communicates with the rear part of the cylindrical bore 6*b* over the time period from when the starter 1 is in a stopped state as shown in FIG. 2A to when the starter 1 is brought into a driving state as shown FIG. 2B. Here, the driving state of the starter 1 denotes a state where the pinion 7 has been brought into mesh with the ring gear G (see FIG. 1) of the engine and the torque generated by the motor 2 is transmitted from the pinion 7 to the ring gear G to start the engine.

In addition, it should be noted that the grooves 17 may also be formed in the inner surface of the front part of the cylindrical bore 6*b* instead of in the outer surface of the front part of the output shaft 5.

The starter 1 further includes a seal member 18 that is provided on the outer periphery of the main body 6A of the pinion tube 6 so as to be positioned in front of the bearing 15. The seal member 18 functions to block foreign matter, such as water and dust, from intruding into the starter 1. In the present embodiment, the seal member 18 is implemented by, for example, a rubber-made oil seal. The seal member 18 is retained by the housing 16 with a lip portion of the seal member 18 in sliding contact with the outer surface of the main body 6A of the pinion tube 6.

On the rear side of the pinion tube 6, there is provided means for transmitting a shifting force (or pushing force) of the shift lever 8 to the pinion tube 6; the shifting force is created by operation of the electromagnetic switch 9 in the axial direction away from the motor 2 (i.e., in the forward direction).

Specifically, in the present embodiment, the shifting force-transmitting means is made up of a resin-made annular collar 19, a lever-engaging member 20 and first and second restricting members 21 and 22. As shown in FIGS. 1 and 2A-2B, the collar 19 is fitted to the outer periphery of the main body 6A of the pinion tube 6 so as to be rotatable relative to the pinion tube 6. The lever-engaging member 20 is integrally resin-formed with the collar 19 and arranged so as to engage with one end of the shift lever 8. The first restricting member 21 restricts movement of the collar 19 in the axial direction toward the pinion 7 (i.e., in the forward direction). The first restricting member 21 is integrally formed with the pinion tube 6 and shaped into an annular flange that protrudes radially outward from the outer surface of the pinion tube 6 and circumferentially extends over the entire circumference of the pinion tube 6. On the other hand, the second restricting member 22 restricts movement of the collar 19 in the axial direction away from the pinion 7 (i.e., in the backward direction). The second restricting member 22 is separately formed from the pinion tube 6 so as to have an annular shape and fixed to the outer surface of the pinion tube 6. More specifically, the second restricting member 22 is implemented by, for example, a washer that is press-fitted to the outer periphery of the main body GA of the pinion tube 6. In addition, it should be noted that the first restricting member 21 may also be formed in the same manner as the second restricting member 22.

The pinion 7 is separately formed from the pinion tube 6 and fitted on the pinion-sliding portion 6B of the pinion tube 6 so as to be axially movable relative to the pinion-sliding portion 6B. Further, the pinion 7 is urged by a pinion spring 23 in the axial direction away from the motor 2 (i.e., in the forward direction). The pinion 7 is also restricted in movement in the axial direction away from the motor 2 by a pinion stopper 24 that is provided at the front end of the pinion-sliding portion GB of the pinion tube 6.

Moreover, the pinion 7 has both a small-diameter bore 7*b* and a large-diameter bore 7*c* formed therein; the diameter of the large-diameter bore 7*c* is larger than that of the small-diameter bore 7*b*.

More specifically, the small-diameter bore 7*b* is formed on the front side so as to extend in the axial direction of the pinion 7 and open at the front end of the pinion 7. Further, in the inner surface of the small-diameter bore 7*b*, there are formed straight spline grooves 7*a* that extend in the axial direction of the pinion 7. On the other hand, the large-diameter bore 7*c* is formed on the rear side so as to extend in the axial direction of the pinion 7 and open at the rear end of the pinion 7. However, in the inner surface of the large-diameter bore 7*c*, there are formed no spline grooves. In addition, the small-diameter bore 7*b* and the large-diameter bore 7*e* communicate with each other in the axial direction of the pinion 7.

The pinion 7 is relatively-movably assembled to the pinion tube 6 by inserting the pinion-sliding portion 6B of the pinion tube 6 through the large-diameter bore 7*c* into the small-diameter bore 7*b* of the pinion 7 and thereby bringing the straight spline teeth 6*c* of the pinion tube 6 into mesh with the straight spline grooves 7*a* of the pinion 7. In addition, a front end portion of the main body 6A of the pinion tube 6 is fitted into a rear end portion of the large-diameter bore 7*c* of the pinion 7.

The pinion spring 23 is axially interposed between a radially-extending outer shoulder that is formed between the outer surfaces of the main body 6A and pinion-sliding portion 613 of the pinion tube 6 and a radially-extending inner shoulder that is formed between the inner surfaces of the small-diameter bore 7*b* and large-diameter bore 7*c* of the pinion 7.

Referring again to FIG. 1, the electromagnetic switch 9 includes: an electromagnetic solenoid SL that drives a plunger 25 by the attraction of an electromagnet and has a frame that also forms a magnetic circuit of the electromagnetic solenoid SL; and a resin cover 26 that receives the main contacts of the motor circuit therein and is crimp-fixed to an open end of the frame of the electromagnetic solenoid SL.

More specifically, the electromagnetic solenoid SL includes: an excitation coil 27 that forms the electromagnet upon being supplied with electric power; the plunger 25 that is axially-movably disposed radially inside of the excitation coil 27; a return spring 28 that returns the plunger 25 to its initial rest position when the electric power supply to the excitation coil 27 is interrupted and thus the attraction of the electromagnet for the plunger 25 disappears; a drive spring 29 for developing a reaction force for shifting the pinion 7 into mesh with the ring gear G of the engine; and a joint 30 for transmitting motion of the plunger 25 to the shift lever 8 via the drive spring 29.

The main contacts of the motor circuit are made up of a pair of fixed contacts (not shown) and a movable contact (not shown). The fixed contacts are connected to the motor circuit via a pair of terminal bolts 31 and 32, respectively; both the terminal bolts 31 and 32 are fixed to the resin cover 26. The movable contact is configured to move along with the plunger 25 to electrically connect and disconnect the fixed contacts.

More specifically, when the plunger 25 is attracted by the attraction of the electromagnet to move backward (i.e., rightward in FIG. 1), the movable contact also moves backward to make contact with and thereby electrically connect the fixed contacts. Consequently, the main contacts of the motor circuit are closed. On the other hand, when the attraction of the electromagnet disappears and thus the plunger 25 is returned by the return spring 28 forward (i.e., leftward in FIG. 1) to its initial rest position, the movable contact also moves forward to get away from and thereby electrically disconnect the fixed contacts. Consequently, the main contacts of the motor circuit are opened.

The shift lever 8 has a fulcrum portion 8*a* rotatably supported by the housing 16, so that it can pivot on the fulcrum portion 8*a*. Further, one end of the shift lever 8 which is on one side of the fulcrum portion 8*a* is arranged to engage with the lever-engaging member 20 as described previously. The other end of the shift lever 8 which is on the other side of the fulcrum portion 8*a* is mechanically connected to the joint 30 of the electromagnetic switch 9.

Next, operation of the starter 1 according to the present embodiment will be described.

When a starter switch (not shown) of the vehicle is turned on, the excitation coil 27 of the electromagnetic switch 9 is supplied with electric power from the battery, thereby forming the electromagnet. The electromagnet attracts the plunger 25 to move backward against the reaction force of the return spring 28. The backward movement of the plunger 25 causes the shift lever 8 to pivot clockwise, thereby shifting both the pinion tube 6 and the pinion 7 forward along the output shaft 5. Further, when a front end face of the pinion 7 comes to make contact with a rear end face of the ring gear G of the engine, the pinion 7 is stopped and thus only the pinion tube 6 is further shifted forward against the reaction force of the pinion spring 23.

Then, the plunger 25 further moves backward against both the reaction forces of the return spring 28 and the drive spring 29, thereby causing the main contacts of the motor circuit to be closed. Consequently, electric power is supplied from the battery to the motor 2, thereby enabling the motor 2 to generate torque. The generated torque is then amplified by the speed reducer 3 and transmitted to the pinion tube 6 via the clutch 4 and the output shaft 5, thereby causing the pinion tube 6 to rotate together with the pinion 7. When the pinion 7 has rotated to a position where it can be meshed with the ring gear G, the pinion tube 6 and the pinion 7 are together shifted forward by both the reaction force developed in the drive spring 29 and an axial thrust and the pinion 7 is alone further shifted forward by the reaction force of the pinion spring 23. Here, the axial thrust is converted from the torque generated by the motor 2 via the meshing engagement between the male helical splines 5*a* of the output shaft 5 and the female helical splines 6*a* of the pinion tube 6. Consequently, the pinion 7 is brought into mesh with the ring gear G thereby allowing the torque generated by the motor 2 to be transmitted from the pinion 7 to the ring gear G to start the engine.

After the engine has been completely started, the starter switch is turned off, thereby interrupting the electric power supply from the battery to the excitation coil 27 of the electromagnetic switch 9. Consequently, the attraction of the electromagnet for the plunger 25 disappears, so that the plunger 25 is moved forward by the reaction force of the return spring 28 to its initial rest position, causing the main contacts of the motor circuit to be opened. As a result, the electric power supply from the battery to the motor 2 is also interrupted, thereby disabling the motor 2 from rotating and generating torque. At the same time, the forward movement of the plunger 25 causes the shift lever 8 to pivot counter-clockwise, thereby shifting both the pinion tube 6 and the pinion 7 backward along the output shaft 5 to their respective initial rest positions as shown in FIG. 2A. As a result, the pinion 7 is brought out of mesh with the ring gear G.

The above-described starter 1 according to the present embodiment has the following advantages.

In the starter 1, the pinion-sliding portion 6B of the pinion tube 6 is provided at the front end of the pinion tube 6 and positioned forward from the bearing 15 via which the pinion tube 6 is supported by the housing 16. In other words, the pinion-sliding portion 6B is provided at the non-motor-side end of the pinion tube 6 and positioned further from the motor 2 than the bearing 15 is. Moreover, on the pinion-sliding portion 6B of the pinion tube 6, there is straight-spline-fitted the pinion 7 so as to rotate with the pinion tube 6. That is to say, the starter 1 has such a cantilever structure that on the front side (i.e., on the non-motor side) of the pinion 7, there is provided no bearing for supporting the pinion tube 6. Further, the pinion tube 6 is helical-spline-fitted on the output shaft 5 so as to be both rotatable and axially movable relative to the output shaft 5. The rear end portion (i.e., the motor-side end portion) of the output shaft 5 is integrally formed with the inner 4*b* of the clutch 4.

With the above configuration, during the starting of the engine by the starter 1, the shift lever 8 is driven by operation of the electromagnetic switch 9 to shift both the pinion tube 6 and the pinion 7 relative to the output shaft 5 in the axial direction away from the motor 2, thereby bringing the pinion 7 into mesh with the ring gear G of the engine. At the same time, both the output shaft 5 and the clutch 4 are kept axially unmoved. That is, in the starter 1, only the pinion tube 6 and the pinion 7 together make up a moving body that is shifted by the shift lever 8 in the axial direction away from the motor 2 for bringing the pinion 7 into mesh with the ring gear G of the engine. Consequently, the mass of the moving body can be reduced in comparison with that in the starter disclosed in Patent Document 1.

Moreover, in the starter 1, the main body 6A of the pinion tube 6 has the cylindrical bore 6*b* formed therein, and the female helical splines 6*a* are formed on the inner surface of the rear part of the cylindrical bore 6*b*. That is, the main body 6A of the pinion tube 6 has a hollow shape. Consequently, with the hollow shape of the main body 6A, it is possible to further reduce the mass of the moving body that is comprised of the pinion tube 6 and the pinion 7.

As a result, with the reduced mass of the moving body, it is possible to minimize the size of the electromagnetic switch 9 which drives the shift lever 8 to shift the moving body.

Figure 6:
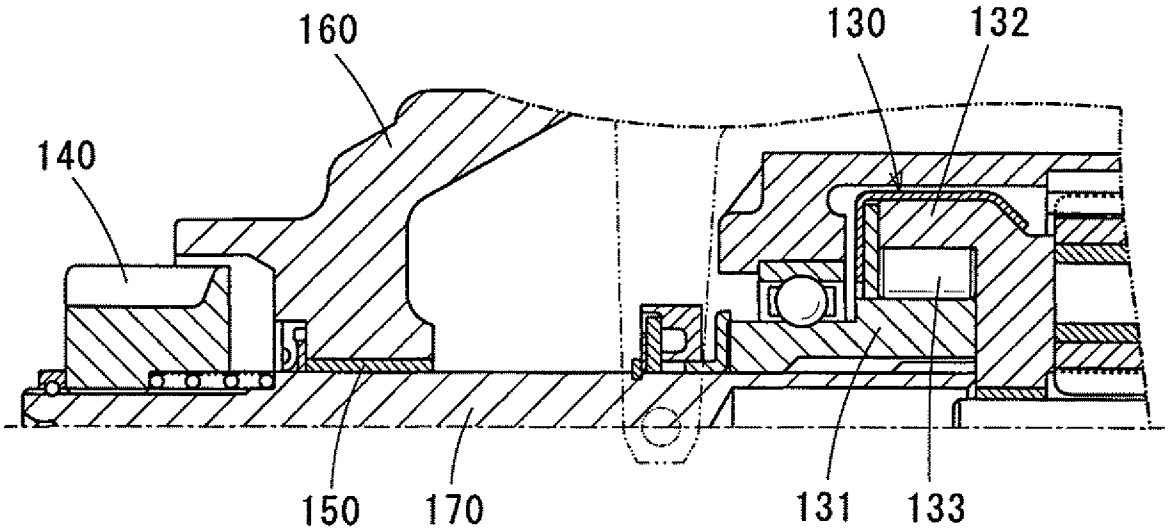
FIG.6 (PRIOR ART)
FIG. 6 is a partially cross-sectional view of part of another starter known in the prior art.

In addition, in the starter disclosed in Patent Document 2, as shown in FIG. 6, the pinion shaft 170 is helical-spline-fitted to the inner periphery of the inner 131 of the clutch 130. Therefore, if the pinion shaft 170 was modified to have a hollow shape, it would be difficult to secure sufficient rigidity of the pinion shaft 170 due to absence of a supporting member arranged radially inside of the pinion shaft 170 to support the pinion shaft 170. Accordingly, it is difficult to modify the pinion shaft 170 to have a hollow shape for the purpose of further reducing the mass of the pinion shaft 170.

Furthermore, in the starter 1, since the rear end portion of the output shaft 5 is integrally formed with the inner 4*b* of the clutch 4, the radial clearances existing in the clutch 4 (i.e., the radial clearance between the outer 4*a* and the rollers 4*c* and the radial clearance between the inner 4*b* and the rollers 4*c*) are not at the same axial position as the radial clearance between the male helical splines 5*a* of the output shaft 5 and the female helical splines 6*a* of the pinion tube 6. In other words, the radial clearances existing in the clutch 4 are axially separated from the radial clearance between the male helical splines 5*a* and the female helical splines 6*a*. Consequently, it is possible to suppress inclination of the pinion tube 6 relative to the output shaft 5 due to all the radial clearances, thereby suppressing wear of other components including the bearings 10 and 15 and the gears 3*a*-3*c* of the speed reducer 3. As a result, it is possible to secure high durability (or a long service life) of the starter 1.

In the starter 1, the pinion 7 is separately formed from the pinion tube 6 and straight-spline-fitted on the pinion-sliding portion 613 of the pinion tube 6 so as to be axially movable relative to the pinion-sliding portion 6B. Further, the pinion 7 is urged in the axial direction away from the motor 2 (i.e., in the forward direction) by the pinion spring 23 that is arranged between the pinion tube 6 and the pinion 7. Furthermore, the pinion 7 is restricted in movement in the axial direction away from the motor 2 by the pinion stopper 24 that is provided on the pinion-sliding portion 6B of the pinion tube 6 so as to be positioned on the non-motor side (i.e., on the front side) of the pinion 7.

With the above configuration, during the starting of the engine by the starter 1, when the pinion 7, which has been shifted forward together with the pinion tube 6 by the shift lever 8 and thereby brought into contact with the rear end face of the ring gear G, is rotated by the torque generated by the motor 2 to reach a position where it can be meshed with the ring gear G it is possible to shift only the pinion 7 further forward by the reaction force of the pinion spring 23. Consequently, it is possible to more reliably bring the pinion 7 into mesh with the ring gear G.

Further, in the starter 1, the pinion tube 6 has the main body 6A and the pinion-sliding portion 6B that is positioned on the non-motor side (i.e., on the front side) of the main body 6A and has a smaller outer diameter than the main body 6A. The main body 6A has the cylindrical bore 6*b* formed therein, while the pinion-sliding portion 6B has the straight spline teeth 6*c* formed on the outer surface thereof. On the other hand, the pinion 7 has the small-diameter bore 7*b* that has the straight spline grooves 7*a* formed in the inner surface thereof and the large-diameter bore 7*c* that is positioned on the motor side (i.e., on the rear side) of the small-diameter bore 7*b* and has a larger diameter than the small-diameter bore 7*b*. The small-diameter and large-diameter bores 7*b* and 7*c* respectively open at the non-motor-side and motor-side ends (i.e., at the front and rear ends) of the pinion 7 and communicate with each other. Moreover, the pinion-sliding portion 6B of the pinion tube 6 is inserted in the small-diameter and large-diameter bores 7*b* and 7*c* of the pinion 7 with the straight spline teeth 6*c* formed on the outer surface of the pinion-sliding portion 6B of the pinion tube 6 in mesh with the straight spline grooves 7*a* formed in the inner surface of the small-diameter bore 7*b* of the pinion 7. The pinion spring 23 is axially interposed between the radially-extending outer shoulder that is formed between the outer surfaces of the main body 6A and pinion-sliding portion 6B of the pinion tube 6 and the radially-extending inner shoulder that is formed between the inner surfaces of the small-diameter and large-diameter bores 7*b* and 7*c* of the pinion 7.

With the above configuration, the pinion 7 can be axially moved relative to the pinion tube 6 via the meshing engagement between the straight spline teeth 6*c* formed on the outer surface of the pinion-sliding portion 6B of the pinion tube 6 and the straight spline grooves 7*a* fowled in the inner surface of the small-diameter bore 7*b* of the pinion 7. Moreover, the pinion spring 23 is received in the internal space which is enclosed by the inner surface of the large-diameter bore 7*c* of the pinion 7, the outer surface of the pinion-sliding portion 6B of the pinion tube 6, the radially-extending inner shoulder formed between the inner surfaces of the small-diameter and large-diameter bores 7*b* and 7*c* of the pinion 7, and the radially-extending outer shoulder formed between the outer surfaces of the main body 6A and pinion-sliding portion 6B of the pinion tube 6. Consequently, the pinion spring 23 can be reliably protected from foreign matter, such as water and dust. As a result, deterioration in performance of the pinion spring 23 can be effectively suppressed.

In the starter 1, the inner surface of the front part of the cylindrical bore 6*b* of the pinion tube 6 and the outer surface of the front part of the output shaft 5 make up sliding surfaces against each other. Further, in the outer surface of the front part of the output shaft 5, there are formed the grooves 17 via which the internal space S formed between the front end of the output shaft 5 and the closed end of the cylindrical bore 6*b* of the pinion tube 6 communicates with the rear part of the cylindrical bore 6*b*.

Consequently, with the grooves 17, it is possible to reduce an axial load which is imposed on the pinion tube 6 when the pinion tube 6 is axially moved relative to the output shaft 5.

More specifically, assume that the internal space S is a substantially closed space. During the starting of the engine by the starter 1, as the pinion tube 6 is shifted forward by the shift lever 8, the volume of the internal space S is increased and thus the air in the internal space S expands to decrease the air pressure in the internal space S. After the engine has been completely started, as the pinion tube 6 is returned backward, the volume of the internal space S is decreased and thus the air in the internal space S is compressed to increase the air pressure in the internal space S. The difference between the air pressure in the internal space S and the air pressure outside the internal space S acts as an axial load on the pinion tube 6, thereby hampering the axial movement of the pinion tube 6.

However, in the starter 1, with the grooves 17 formed in the outer surface of the front part of the output shaft 5, the internal space S communicates with the rear part of the cylindrical bore 6*b*, thereby reducing the difference between the air pressure in the internal space S and the air pressure outside the internal space S. Consequently, the axial load acting on the pinion tube 6 is reduced, thereby allowing the pinion tube 6 to be axially moved more smoothly.

Second Embodiment

This embodiment illustrates a starter 1 which has almost the same structure as the starter 1 according to the first embodiment; accordingly, only the difference therebetween will be described hereinafter.

Figure 3:
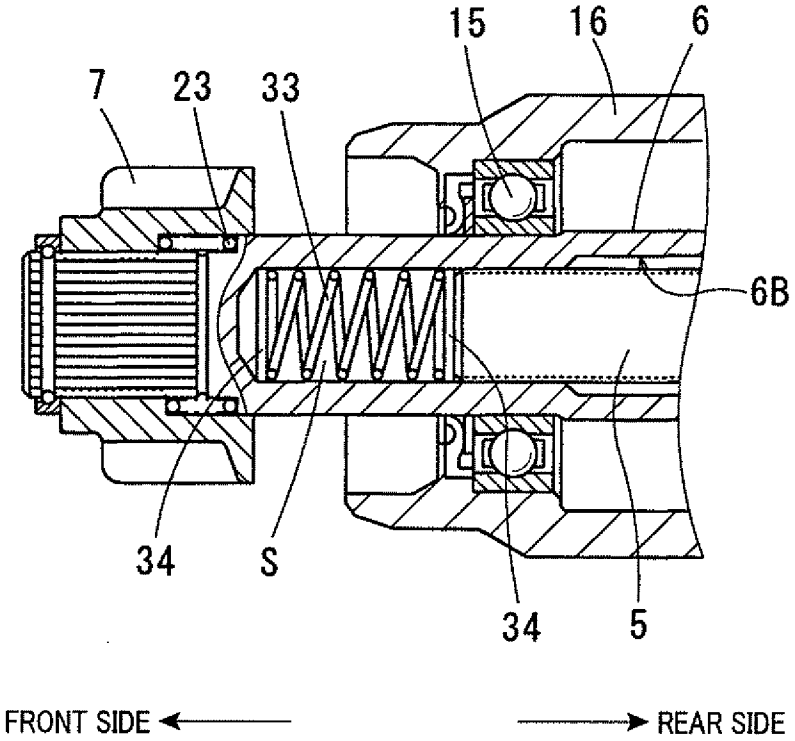
FIG. 3 is a partially cross-sectional view of part of a starter according to a second embodiment.

In the present embodiment, as shown in FIG. 3, the starter 1 further includes a coil spring 33 that is arranged in the internal space S formed between the front end of the output shaft 5 and the closed end of the cylindrical bore 6*b* of the pinion tube 6.

More specifically, the coil spring 33 has its rear end supported by the front end of the output shaft 5 and its front end supported by the closed end of the cylindrical bore 6*b* of the pinion tube 6, so as to urge the pinion tube 6 forward (i.e., toward the non-motor side) relative to the output shaft 5.

With the coil spring 33, during the starting of the engine by the starter 1, when the pinion 7, which has been shifted forward together with the pinion tube 6 by the shift lever 8 and thereby brought into contact with the rear end face of the ring gear G, is rotated by the torque generated by the motor 2 to reach a position where it can be meshed with the ring gear G, it is possible to shift the pinion tube 6 together with the pinion 7 further forward relative to the output shaft 5 by the reaction force of the coil spring 33. Consequently, it is possible to more reliably bring the pinion 7 into mesh with the ring gear G.

Moreover, since the coil spring 33 is received in the internal space S formed inside of the pinion tube 6, it is possible to reliably protect the coil spring 33 from foreign matter, such as water and dust. Consequently, it is possible to effectively suppress deterioration in performance of the coil spring 33.

In addition, as shown in FIG. 3, in the present embodiment, the starter 1 also includes the pinion spring 23 as in the first embodiment. However, it should be noted that with the coil spring 33, it is possible to omit the pinion spring 23 from the starter 1.

Furthermore, in the present embodiment, the starter 1 further includes both first and second washers 34. The first washer 34 is interposed between the rear end of the coil spring 33 and the front end of the output shaft 5 so as to be rotatable relative to the coil spring 33 and the output shaft 5. On the other hand, the second washer 34 is interposed between the front end of the coil spring 33 and the closed end of the cylindrical bore 6*b* of the pinion tube 6 so as to be rotatable relative to the coil spring 33 and the pinion tube 6.

With the above first and second washers 34, it is possible to suppress wear of the coil spring 33 due to relative rotation between the output shaft 5 and the pinion tube 6.

It should be noted that for more effectively suppressing wear of the coil spring 33, it is also possible to arrange more than one first washer 34 on the rear side and more than one second washer 34 on the front side of the coil spring 33.

In addition, though the starter 1 according to the present embodiment includes both the first and second washers 34 that are respectively arranged on the rear and front sides of the coil spring 33, it is also possible to omit either the first or the second washer 34 from the starter 1.

Third Embodiment

This embodiment illustrates a starter 1 which has almost the same structure as the starter 1 according to the first embodiment; accordingly, only the difference therebetween will be described hereinafter.

In the first embodiment, the pinion 7 is straight-spline-fitted on the pinion-sliding portion 613 of the pinion tube 6.

Figure 4:
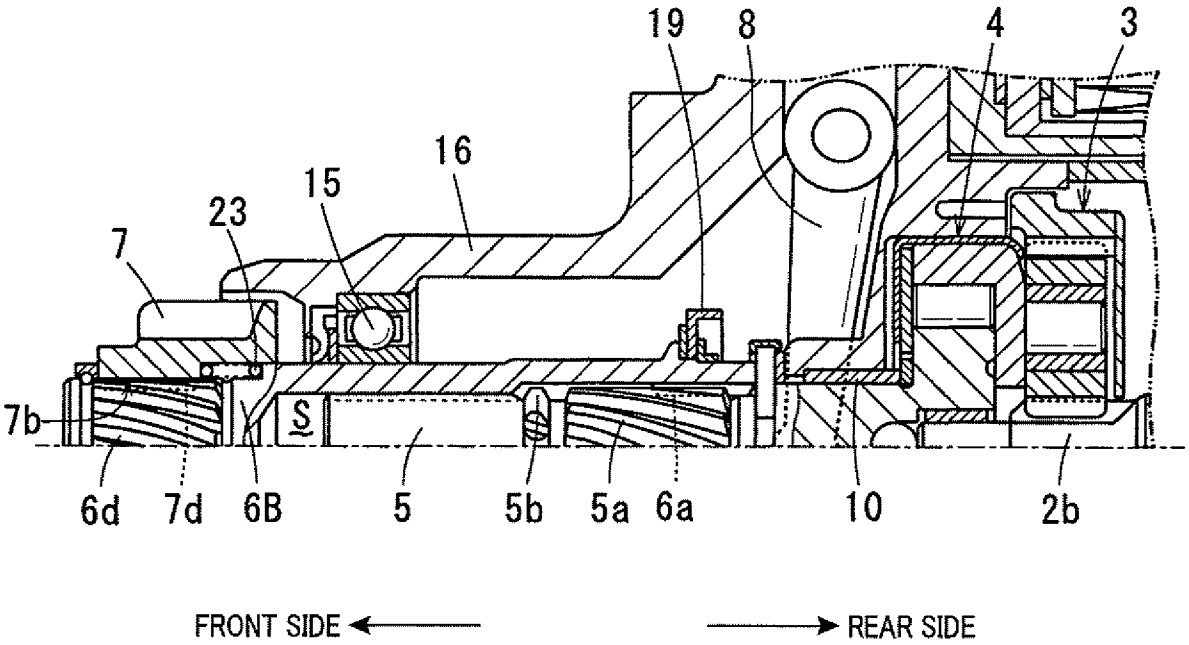
FIG. 4 is a partially cross-sectional view of part of a starter according to a third embodiment.
Figure 5:
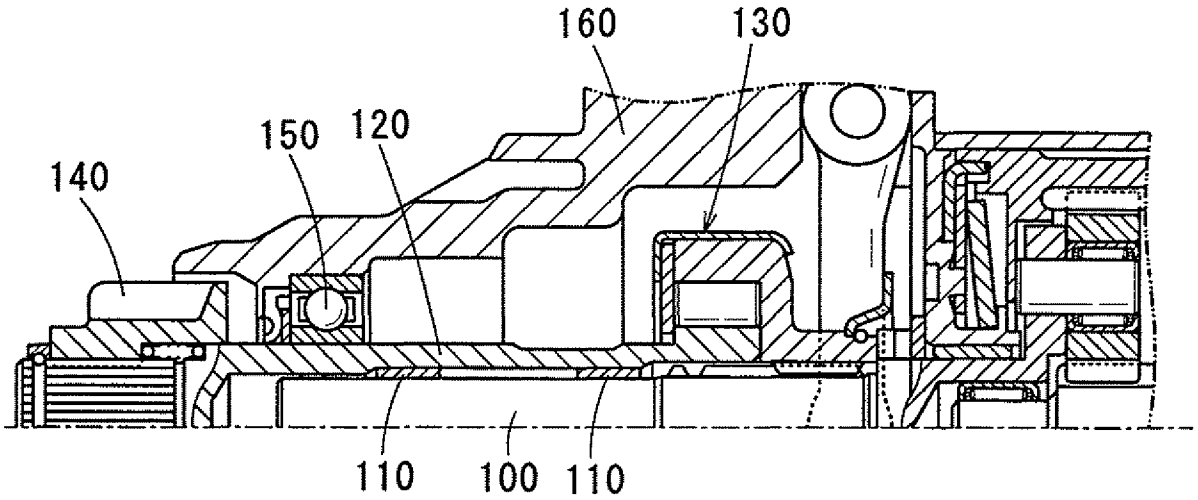
FIG.5 (PRIOR ART)
FIG. 5 is a partially cross-sectional view of part of a starter known in the prior art.

In comparison, in the present embodiment, as shown in FIG. 4, the pinion 7 is helical-spline-fitted on the pinion-sliding portion 6B of the pinion tube 6.

More specifically, in the present embodiment, the pinion-sliding portion 6B of the pinion tube 6 has male helical splines 6*d* formed on the outer surface thereof, while the pinion 7 has female helical splines 7*d* formed on the inner surface of the small-diameter bore 7*b* thereof. The pinion-sliding portion 6B of the pinion tube 6 is inserted in the small-diameter and large-diameter bores 7*b* and 7*c* of the pinion 7 with the male helical splines 6*d* in mesh with the female helical splines 7*d*.

With the above configuration, during the starting of the engine by the starter 1, when the pinion 7, which has been shifted forward together with the pinion tube 6 by the shift lever 8 and thereby brought into contact with the rear end face of the ring gear G, is rotated by the torque generated by the motor 2 to reach a position where it can be meshed with the ring gear G, it is possible to shift the pinion 7 further forward by an axial thrust; the axial thrust is converted from the torque generated by the motor 2 via the meshing engagement between the male helical splines 6*d* of the pinion tube 6 and the female helical splines 7*d* of the pinion 7. Consequently, it is possible to more reliably bring the pinion 7 into mesh with the ring gear G.

While the above particular embodiments have been shown and described, it will be understood by those skilled in the art that various modifications, changes, and improvements may be made without departing from the spirit of the invention.

For example, in the previous embodiments, the clutch 4 is implemented by the one-way roller clutch in which the rollers 4*c* are interposed as intermediate members between the outer 4*a* and the inner 4*b*. However, the clutch 4 may also be implemented by other types of one-way clutches, such as a one-way sprag clutch which includes sprags instead of the rollers 4*c* and a one-way cam clutch which includes cams instead of the rollers 4*c*.

In the previous embodiments, the motor 2 is implemented by the DC commutator motor. However, the motor 2 may also be implemented by other types of motors, such as an AC motor.

In the previous embodiments, the pinion 7 is separately formed from the pinion tube 6 and fitted on the pinion tube 6. However, the pinion 7 may also be integrally formed with the pinion tube 6 into one piece.

In the previous embodiments, the electromagnetic switch 9 includes the single electromagnetic solenoid SL which performs both the function of driving the shift lever 8 and the function of operating (i.e. closing and opening) the main contacts of the motor circuit.

However, the electromagnetic switch 9 may also be implemented by a tandem electromagnetic switch which includes first and second electromagnetic solenoids arranged in tandem; the first electromagnetic solenoid performs the function of driving the shift lever 8, while the second electromagnetic solenoid performs the function of operating the main contacts of the motor circuit. Further, the first and second electromagnetic solenoids may be both received in a common frame or respectively received in two different frames.

In addition, in the case of the electromagnetic switch 9 being implemented by a tandem electromagnetic switch, it is possible to separately control the operations of the first and second electromagnetic solenoids by an ECU (Electronic Control Unit), thereby making the starter 1 more suitable for use in a vehicle that is equipped with an Idling Stop System (ISS). The ISS is designed to stop injection of fuel into the engine of the vehicle and thereby automatically stop the engine when the vehicle makes a brief stop for, by way of example, waiting for a traffic light to change or traffic congestion.

What is claimed is:

1. A starter for starting an engine, the starter comprising:

a motor having a rotating shaft;

an output shaft coaxially disposed with the rotating shaft of the motor, the output shaft having male splines formed on an outer surface thereof;

a clutch configured to transmit torque generated by the motor to the output shaft;

a pinion tube having a cylindrical bore formed therein, the pinion tube also having female splines formed on an inner surface of the cylindrical bore, the pinion tube being fitted on the output shaft with the female splines in mesh with the male splines of the output shaft;

a pinion provided on a non-motor-side end portion of the pinion tube so as to rotate with the pinion tube;

a shift lever that is configured to shift both the pinion tube and the pinion relative to the output shaft in a direction away from the motor and thereby bring the pinion into mesh with a ring gear of the engine; and an electromagnetic solenoid configured to drive the shift lever, wherein the clutch is a one-way clutch which includes an outer, an inner and a plurality of intermediate members, the outer is arranged so as to be rotated by the torque generated by the motor, the inner is disposed radially inside of the outer so as to be rotatable relative to the outer, the inner is integrally formed with a motor-side end portion of the output shaft so as to rotate with the output shaft, and the intermediate members are arranged between the outer and the inner so as to allow torque transmission from the outer to the inner and inhibit torque transmission from the inner to the outer, and the pinion is separately formed from the pinion tube and mounted on the pinion tube so as to be axially movable relative to the pinion tube.

2. The starter as set forth in claim 1, wherein the electromagnetic solenoid includes an excitation coil that forms an electromagnet upon being supplied with electric power, and the electromagnetic solenoid drives the shift lever to shift both the pinion tube and the pinion in the direction away from the motor by means of attraction of the electromagnet.

3. The starter as set forth in claim 1, wherein the cylindrical bore of the pinion tube has an open end on the motor side and a closed end on the non-motor side, the output shaft is inserted in the cylindrical bore of the pinion tube with an internal space formed between a non-motor-side end of the output shaft and the closed end of the cylindrical bore, and in the internal space, there is arranged a spring so as to urge the pinion tube relative to the output shaft in the direction away from the motor.

4. The starter as set forth in claim 3, further comprising at least one washer interposed between a motor-side end of the spring and the non-motor-side end of the output shaft so as to be rotatable relative to the spring and the output shaft.

5. The starter as set forth in claim 3, further comprising at least one washer interposed between a non-motor-side end of the spring and the closed end of the cylindrical bore of the pinion tube so as to be rotatable relative to the spring and the pinion tube.

6. The starter as set forth in claim 1, wherein the pinion is urged in the direction away from the motor by a pinion spring that is arranged between the pinion and the pinion tube, and the pinion is also restricted in movement in the direction away from the motor by a pinion stopper that is provided on the pinion tube so as to be positioned on the non-motor side of the pinion.

7. The starter as set forth in claim 6, wherein the pinion tube has a main body and a pinion-sliding portion that is positioned on the non-motor side of the main body and has a smaller outer diameter than the main body, the main body having the cylindrical bore of the pinion tube formed therein, the pinion-sliding portion having straight spline teeth formed on an outer surface thereof, the pinion has a small-diameter bore that has straight spline grooves formed in an inner surface thereof and a large-diameter bore that is positioned on the motor side of the small-diameter bore and has a larger diameter than the small-diameter bore, the small-diameter and large-diameter bores respectively opening at the non-motor-side and motor-side ends of the pinion and communicating with each other, the pinion-sliding portion of the pinion tube is inserted in the small-diameter and large-diameter bores of the pinion with the straight spline teeth formed on the outer surface of the pinion-sliding portion of the pinion tube in mesh with the straight spline grooves formed in the inner surface of the small-diameter bore of the pinion, and the pinion spring is axially interposed between a radially-extending outer shoulder that is formed between the outer surfaces of the main body and pinion-sliding portion of the pinion tube and a radially-extending inner shoulder that is formed between the inner surfaces of the small-diameter and large-diameter bores of the pinion.

8. The starter as set forth in claim 1, wherein the cylindrical bore of the pinion tube has an open end on the motor side and a closed end on the non-motor side, the cylindrical bore also has a motor-side part and a non-motor-side part that has a smaller diameter than the motor-side part, the female splines of the pinion tube are formed on the inner surface of the motor-side part of the cylindrical bore, a radial clearance between the inner surface of the non-motor-side part of the cylindrical bore and the outer surface of a non-motor-side part of the output shaft is set so as to allow for the inner surface of the non-motor-side part of the cylindrical bore and the outer surface of the non-motor-side part of the output shaft to make up sliding surfaces against each other, and in the inner surface of the non-motor-side part of the cylindrical bore or in the outer surface of the non-motor-side part of the output shaft, there are formed grooves via which an internal space formed between a non-motor-side end of the output shaft and the closed end of the cylindrical bore communicates with the motor-side part of the cylindrical bore.

9. The starter as set forth in claim 1, wherein the starter has such a cantilever structure that on the non-motor side of the pinion, there is provided no bearing for supporting the pinion tube.

* * * * *